United States Patent [19]

Wang

[11] Patent Number: 4,949,231

[45] Date of Patent: Aug. 14, 1990

[54] VARIABLE LIGHT BEAM FLASHLIGHT

[76] Inventor: Fu H. Wang, No. 7, Alley 14, Lane 64, Ching Ping Rd., Chung Ho City, Taipei Hsien, Taiwan

[21] Appl. No.: 399,717

[22] Filed: Aug. 28, 1989

[51] Int. Cl.[5] ..... F21L 7/00

[52] U.S. Cl. ..... 362/206; 362/183; 362/205; 362/188

[58] Field of Search ..... 362/183, 188, 202, 203, 362/205, 206, 187

[56] References Cited

U.S. PATENT DOCUMENTS

| | | | |
|---|---|---|---|
| 4,733,337 | 3/1988 | Bieberstein | 362/206 |
| 4,777,582 | 10/1988 | Sharrah | 362/205 |
| 4,823,242 | 4/1989 | Maglica et al. | 362/206 X |

*Primary Examiner*—Stephen F. Husar

*Attorney, Agent, or Firm*—Rogers, Howell & Haferkamp

[57] ABSTRACT

A flashlight includes a tube; a control ferrule with an inner helical groove being rotatably disposed on the front portion of the tube; a face cap with a lens and a reflector being provided on the front end of the front portion; and one or more batteries being disposed within the tube. A socket with two conductors respectively connected to two prongs of a light bulb is slidably disposed within the front portion of the tube. A pin couples the socket to the control ferrule so that the socket is guided to move along the guide holes of the tube by the relative movement between the pin and the control ferrule. A sleeve is disposed on one end of a tail cap for engaging into a rear end of the tube. A small gap separates the sleeve and the tail cap. A spring member is disposed between the tail cap and the battery so as to urge the tail cap not to electrically connect to the tube. An intermittent gentle pressure on the tail cap causes the tail cap intermittently connected with the tube and produces an intermittent lighting of the light bulb.

9 Claims, 3 Drawing Sheets

VARIABLE LIGHT BEAM FLASHLIGHT

BACKGROUND OF THE INVENTION

The present invention relates to a flashlight, and more particularly relates to a flashlight which can be intermittently turn on and off easily.

Flashlights having variable focus or having variable dispersion light beam are disclosed in U.S. Pat. No. 4,398,238 (Norman C. Nelson, "Variable focus flashlight", Ser. No. 303,418, filed Dec. 4, 1981) and U.S. Pat. No. 4,819,141 (Anthony Maglica, "Flashlight", Ser. No. 43,086, filed Apr. 27, 1987). The mechanism for producing light beam having variable dispersion are relatively complicate. Besides, no flashlights can be turn on and off intermittently.

The present invention has arisen to mitigate and/or obviate the afore-described disadvantages of the conventional flashlights.

SUMMARY OF THE INVENTION

A primary objective of the present invention is to provide a flashlight which can be intermittently turned on and off easily.

Another objective of the present invention is to provide a flashlight whose structure is relatively simple and effective.

Further objects and advantages of the present invention will become apparent from a careful reading of the detailed description provided hereinbelow, with appropriate reference to the accompanying drawings.

DETAILED DESCRIPTION OF THE INVENTION

Figure 1:
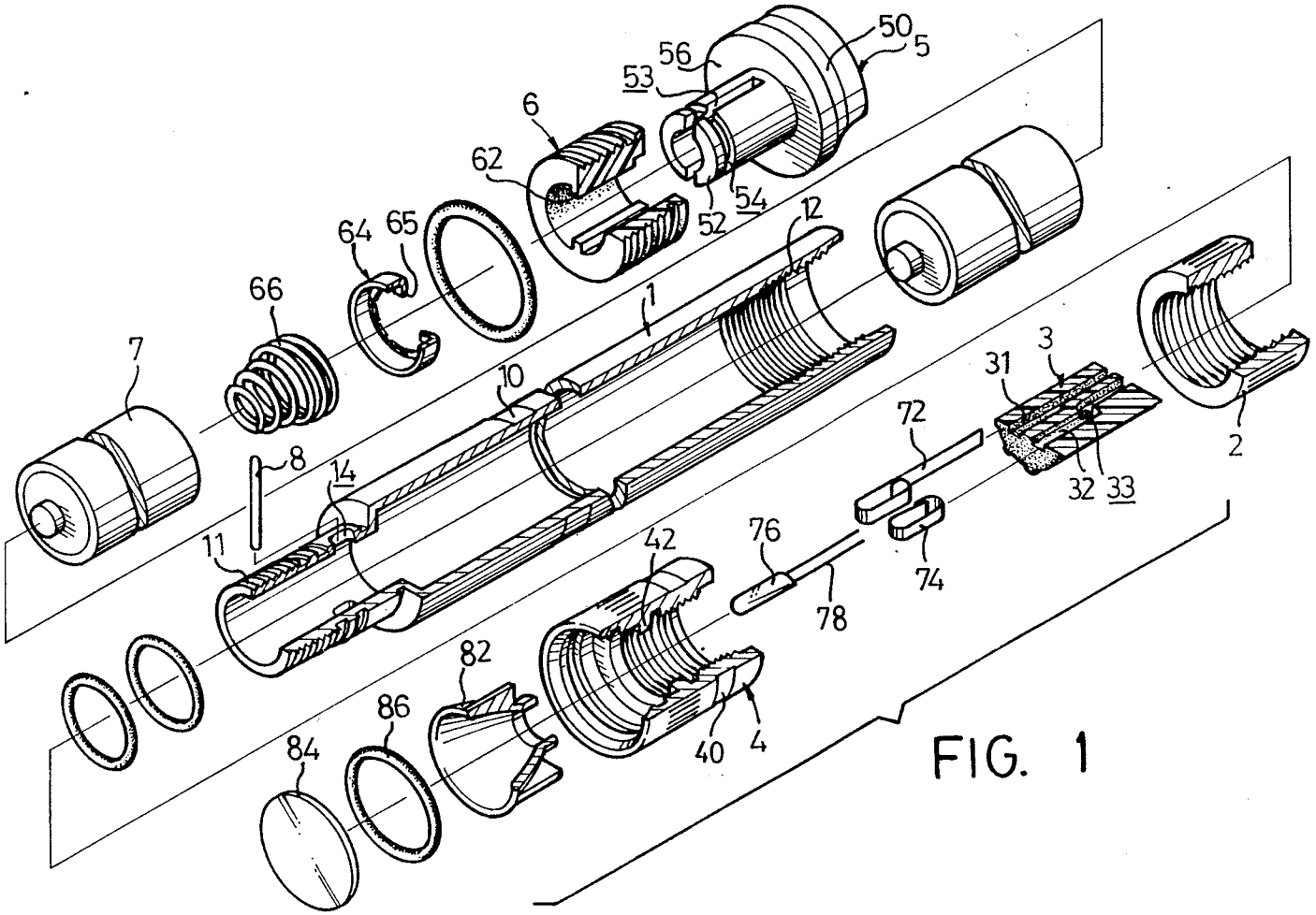
FIG. 1 is an exploded perspective view of a flashlight in accordance with the present invention.
Figure 2:
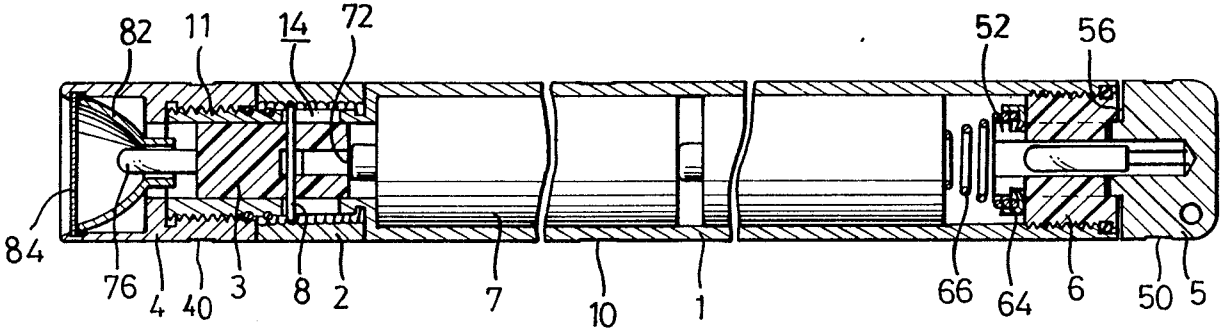
FIG. 2 is a cross-sectional view of the assembled flashlight of FIG. 1.

Referring to FIGS. 1 and 2, the flashlight in accordance with the present invention generally comprises a cylindrical tube 1, a control ferrule 2, a slidable socket 3, a face cap 4, a tail cap 5, a sleeve 6, and batteries 7.

A reduced diameter portion 11 with an outer thread substantially occupied half the length thereof is formed at a front end of the cylindrical tube 1, and an inner thread 12 is formed in the rear end of the cylindrical tube 11. The batteries 7 are disposed within the cylindrical tube 1. A pair of opposite oblong openings 14 are formed on the reduced diameter portion 11. The control ferrule 2 with an inner helical groove or inner thread, e.g., round thread, is freely rotatably provided on the rear half of the reduced diameter portion 11 without thread. The slidable socket 3 has two longitudinal grooves 31, 32 for receiving a respective conductor 72 or 74. Two prongs 78 of a light bulb 76 are respectively inserted into the grooves 31, 32 to contact the conductors 72, 74. A free end of the conductor 72 is folded to bear against a bottom surface of the slidable socket 3 in order to be engaged with a center electrode of an adjacent battery 7. A transverse hole 33 is formed in the slidable socket 3. A guide means, such as a pin 8 penetrates through the oblong holes 14 and the transverse hole 33 so as to slidably hold the slidable socket 3. The longitudinal movement of the slidable socket 3 or the pin 8 is limited by the oblong holes 14. Both ends of the pin 8 are engaged in the inner thread of the control ferrule 2. The pin 8 is forced to move up and down along the oblong hole 14 by a relative rotational movement between the control ferrule 2 and the front end 11 of the cylindrical tube 1 so that the slidable socket 3 can slidably move up and down by means of the pin 8.

A parabolic reflector 82, a lens 84 and a sealing ring 86 are disposed in a front end of the face cap 4. The cap 4 with an annular inner flange 42 is threadedly engaged on the front end of the reduced diameter portion 11 until the annular flange 42 contacts the most forward end surface of the portion 11. Two longitudinal ribs 62 are oppositely formed in the sleeve 6. A short cylinder 52 with a pair of opposite slots 53 and an annular groove 54 is integrally formed on one end of the tail cap 5 so that an annular surface 56 is formed. The sleeve 6 which is generally made of insulating materials is engaged on the short cylinder 52 with the ribs 62 respectively engaged within the slots 53. The movement of the sleeve 6 on the short cylinder 52 is limited by a retaining ring 64 which is engaged with an inward flange 65 on the annular groove 54 of the tail cap 5. A small gap exist between the sleeve 6 and the tail cap 5 so that the sleeve 6 can move longitudinally on the short cylinder 52 for a small distance. The tail cap 5 is engaged on the rear end of the cylindrical tube 1 by means of the threaded engagement between the outer thread of the sleeve 6 and the inner thread 12 of the cylindrical tube 1.

Referring again to FIG. 2, the face cap 4 is disposed on the front end of the portion 11. The pin 8 is moved to a position near the top of the oblong hole 14. At this position, the foremost battery 7 bears against the shoulder between the reduced diameter portion 11 and the cylindrical tube 1; and the conductor 72 still contacts the center electrode of the adjacent battery 7. The tail cap 5 and the sleeve 6 are engaged with the sleeve 6 in the rear end of the cylindrical tube 1. The sleeve 6 is not completely threaded into the tube 1 so that a small gap separates the tail cap 5 and the sleeve 6. At this position, the annular surface 56 of the tail cap 5 does not contact the rear end of the cylindrical tube 1. The electrical circuit of the flashlight is open because the gap separates the tail cap 5 and the sleeve 6. The tail cap 5 is electrically connected to the case electrode of a rearmost battery 7 through the short cylinder 52 and/or the retaining ring 64 and the spring 66; and the cylindrical tube 1 is electrically connected to the center electrode of the foremost battery 7. When a pressure is applied to the tail cap 5 to push it forward, the annular surface 56 of the tail cap 5 contacts the rear end of the cylindrical tube 1 so that the electrical circuit of the flashlight is completed. Therefore, intermittently pressing the tail cap 5 produces an intermittent lighting of the light bulb 76 so that a signal can be easily signaled by the flashlight. Further rotation of the control ferrule 2 makes the socket 3 to move toward the front end of the flashlight so that the electrical connection between the conductor 72 and the center electrode of the nearest battery 7 can be separated so that the electrical circuit of the flashlight is open.

Figure 3:
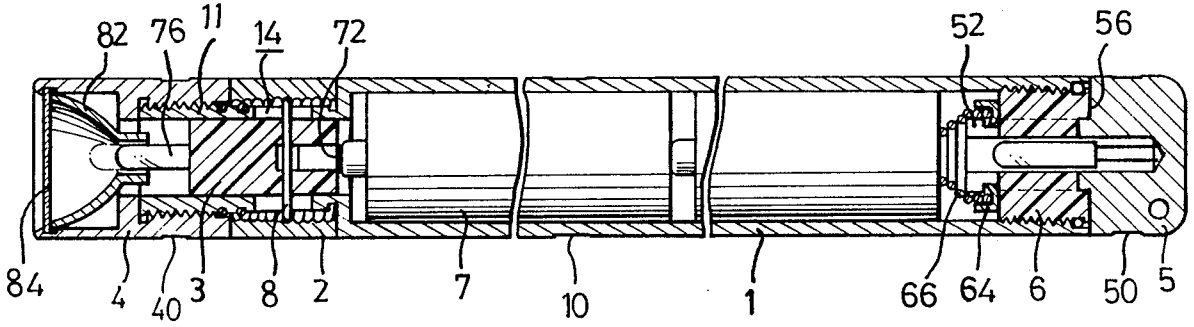
FIG. 3 is a cross-sectional view similar to FIG. 2, illustrating that an electrical circuit of the flashlight is close.

Referring next to FIG. 3, the tail cap 5 is completely threaded onto the cylindrical tube 1 so that the annular surface 56 of the tail cap 5 permanently connects the rear end of the cylindrical tube 1. Therefore, the electrical circuit of the flashlight is closed, and the light bulb 76 is on. A rotational movement of the control ferrule 2 makes the pin 8 move rearward along the oblong hole 14. Therefore, the socket 3 is pushed rearward by the pin 8 to rearward push the batteries 7. Consequently, the light bulb 76 longitudinally slides relative to the reflector 82 so as to produce a variable dispersion of the light beam.

Referring again to the drawings, normally, the outer surfaces of the cylindrical tube 1 and the tail cap 5 are applied with insulating materials except two ring portions 10, 50 respectively provided on the outer surfaces of the cylindrical tube 1 and the tail cap 5. The ring portion 10 electrically connects to the center electrode of the foremost battery 7 via the cylindrical tube 1 and the conductors 72, 74 and the light bulb 76. The other ring portion 50 connects to the casing electrode of the rearmost battery 7 via the tail cap 5 and the spring 66. When the sleeve 6 is not fully threaded into the rear end of the cylindrical tube 1, the spring 66 permanently urges the tail cap 5 rearward so that a gap is formed between the annular surface 56 of the tail cap 5 and the rear end of the cylindrical tube 1. Therefore, the electrical circuit of the flashlight is open. The ring portions 10, 50 can be respectively connected to the two electrode of a power supply of a charging apparatus (not shown) so as to recharge the batteries 7 without taking the batteries 7 out of the cylindrical tube 1. Alternatively, a ring portion 40 which is provided on the outer surface of the face cap and one of the two ring portions 10, 50 are connected to a power supply if the tail cap is electrically connected to the cylindrical tube and the conductor 72 is not connected to the center electrode of the battery 7.

Accordingly, the flashlight in accordance with the present invention has the following advantages:

(a) The light bulb 76 of the flashlight can be turned on and off intermittently in order to signal a signal.

(b) The structure of the flashlight is relatively simple and effective. The cost is thus reduced.

(c) The batteries of the flashlight can be recharged easily without the need to take it off.

While I have described a preferred embodiment of the present invention, numerous modifications, alterations, alternate embodiments, and alternate materials may be contemplated by those skilled in the art and may be utilized in accomplishing the present invention. It is envisioned that all such alternate embodiments are considered to be within the scope of the present invention as defined by the appended claims.

I claim:

1. A flashlight comprising a cylindrical tube enclosed at a rear end by a tail cap, a first portion being formed at a front end of said cylindrical tube; a pair of guide holes being formed in said first portion; a control ferrule with an inner helical groove being freely rotatably disposed on said first portion of said cylindrical tube; and a face cap with a lens and a reflector being provided with said face cap engaged at a front end of said first portion; at least one battery being disposed within said tube; a spring member being located between said tail cap and an adjacent battery; a socket with two conductors respectively connected to two prongs of a light bulb being slidably disposed within said first portion of said tube; two ends of a guide means extending through said guide holes of said first portion and being engaged with said inner helical groove of said control ferrule; said guide means coupling said socket to said control ferrule; said guide means being guided to move along said guide holes of said first portion by a relative motion between said guide means and said control ferrule, and said socket being guided by said guide means to move longitudinally within said first portion.

2. A flashlight as set forth in claim 1, wherein said first portion is a reduced diameter portion.

3. A flashlight as set forth in claim 1, wherein a hole is formed in said socket for receiving said guide means, both ends of said guide means extend through said guide holes of said first portion and engages in said inner groove of said control ferrule so that said guide means is pushed to move along said guide holes of said first portion by a relative movement between said inner groove of said control ferrule and said guide holes.

4. A flashlight as set forth in claim 1, wherein said guide means is a pin.

5. A flashlight as set forth in claim 1, wherein said inner helical groove is a round thread.

6. A flashlight as set forth in claim 1, wherein a first ring portion is formed on an outer surface of said cylindrical tube and a second ring portion is formed on an outer surface of said face cap; said ring portions respectively connect to a power supply for charging said batteries within said cylindrical tube when said conductor is not electrically connected to a center electrode of said battery.

7. A flashlight comprising a cylindrical tube; a face cap with a lens and a reflector being provided with said face cap engaged at a front end of said cylindrical tube; at least one battery being disposed within said tube; a socket with two conductors respectively connected to two prongs of a light bulb being disposed within a front portion of said tube with said light bulb substantially located in the middle of said reflector; a sleeve being disposed on one end of a tail cap and having a small gap therebetween; said tail cap being engaged with said sleeve into a rear end of said cylindrical tube and having a short cylinder formed at one end thereof; a pair of slots being formed on said short cylinder along a longitudinal direction thereof for receiving a pair of ribs formed inside said sleeve; an annular groove being formed at an outer end of said short cylinder for receiving a retainer ring so as to retain said sleeve on said short cylinder; a spring member being disposed between said tail cap and said battery in order to urge said tail cap rearward so that said tail cap is not electrically connected to said cylindrical tube; a first ring portion being formed on an outer surface of said cylindrical tube and a third ring portion being formed on an outer surface of said tail cap; said ring portions respectively connecting to a power supply for charging said batteries within said cylindrical tube when said tail cap is not electrically connected to a casing electrode of said battery; and an intermittent gentle pressure on said tail cap causing said tail cap intermittently connected with said cylindrical tube and producing an intermittent lighting of said light bulb.

8. A flashlight comprising a cylindrical tube; a first portion being formed at a front end of said cylindrical tube; a pair of guide holes being formed in said first portion; a control ferrule with an inner helical groove being freely rotatably disposed on said first portion of said cylindrical tube; and a face cap with a lens and a reflector being provided with said face cap engaged at a front end of said first portion; at least one battery being disposed within said tube; a socket with two conductors respectively connected to two prongs of a light bulb being slidably disposed within said first portion of said tube; two ends of a guide means extending through said guide holes of said first portion and being engaged with said inner helical groove of said control ferrule; said guide means coupling said socket to said control ferrule; said guide means being guided to move along said guide holes of said first portion by a relative motion between said guide means and said control ferrule, and said socket being guided by said guide means to move longitudinally within said first portion; a sleeve being disposed on one end of a tail cap and having a small gap therebetween; said tail cap being engaged with said sleeve into a rear end of said cylindrical tube; a spring member being disposed between said tail cap and said battery in order to urge said tail cap rearward so that said tail cap is not electrically connected to said cylindrical tube; an intermittent gentle pressure on said tail cap causing said tail cap intermittently connected with said cylindrical tube and producing an intermittent lighting of said light bulb.

9. A flashlight as set forth in claim 8, wherein a first ring portion is formed on an outer surface of said cylindrical tube and a third ring portion is formed on an outer surface of said tail cap; said ring portions respectively connect to a power supply for charging said batteries when an electrical circuit of said flashlight is open.

* * * * *